US005385489A

United States Patent [19]

Schell

[11] Patent Number: 5,385,489

[45] Date of Patent: Jan. 31, 1995

[54] SOLDERABLE HOLD-DOWN

[75] Inventor: Mark S. Schell, Palatine, Ill.

[73] Assignee: Berg Technology, Inc., Reno, Nev.

[21] Appl. No.: 150,277

[22] Filed: Nov. 10, 1993

Related U.S. Application Data

[63] Continuation of Ser. No. 43,883, Apr. 7, 1993, abandoned.

[51] Int. Cl.[6] ..... H01R 13/73

[52] U.S. Cl. ..... 439/571

[58] Field of Search ..... 439/571, 572, 83, 876, 439/84; 228/120, 139

[56] References Cited

U.S. PATENT DOCUMENTS

| | | | |
|---|---|---|---|
| 3,320,607 | 5/1967 | Rueger | 439/571 |
| 3,601,750 | 8/1971 | Mancini | 439/84 |
| 4,231,628 | 11/1980 | Hughes et al. | 439/676 |
| 4,447,109 | 5/1984 | Hobart, Jr. | 439/874 |
| 4,583,807 | 4/1986 | Kaufman et al. | 439/83 |
| 4,969,829 | 11/1990 | Sato | 439/83 |
| 4,992,052 | 2/1991 | Verhoeven | 439/62 |
| 5,055,069 | 10/1991 | Townsend et al. | 439/608 |
| 5,090,912 | 2/1992 | Zell | 439/79 |
| 5,104,341 | 4/1992 | Gilissen et al. | 439/608 |
| 5,108,308 | 4/1992 | Northcraft et al. | 439/555 |
| 5,137,454 | 8/1992 | Baechtle | 439/62 |
| 5,176,349 | 1/1993 | Bendorf | 248/220 |
| 5,187,863 | 2/1993 | Wittens | 29/741 |

*Primary Examiner*—Gary F. Paumen

*Attorney, Agent, or Firm*—Woodcock Washburn Kurtz Mackiewicz & Norris

[57] ABSTRACT

The present invention relates to connector hold-downs for mechanically attaching a connector to a circuit board and, specically, to hold-downs that can be secured by solder to plated holes through circuit boards.

12 Claims, 4 Drawing Sheets

SOLDERABLE HOLD-DOWN

This is a continuation, of application Ser. No. 08/043,883, filed Apr. 7, 1993, now abandoned.

BACKGROUND OF THE INVENTION

1. Field of the Invention

This invention relates to connector hold-downs for mechanically attaching a connector to a circuit board and, specically, to hold-downs that can be secured by solder to plated holes through circuit boards.

2. Description of Related Art

Connectors are mechanically attached to printed circuit boards (PCBs) in many ways. One such design bolts connectors to PCBs. See, for instance U.S. Pat. No. 5,055,069. This design is good for connectors of finite length. However, it is not acceptable for modular connectors that can be positioned end-to-end without loss of terminal position between ends of the connectors along a circuit board.

Another design is formed through a heat staking process which calls for heating and then deforming the end of a plastic peg that is integral to a connector housing. A bulged head is produced on the plastic peg by a heat stake process which retains the connector solidly to the PCB. Unfortunately, the processing of the PCB is complicated by the heat staking process. PCBs must be removed from the production line to perform the heat staking operation and then returned to the line, all without disturbing other unsoldered components. FIG. 1 illustrates a prior art right angle Metral TM receptacle 10 that can be positioned end-to-end without loss of terminal position between ends of similar connectors along a circuit board. The right angle Metral TM receptacle 10 illustrated in FIG. 1 has a plastic peg 12 that can be used for mechanically attaching the receptacle 10 to a circuit board through a heat staking process such as the one described in U.S. Pat. No. 5,187,863.

SUMMARY OF THE INVENTION

The invention relates to a right angle connector with a solderable hold-down. The connector can be a modular connector that can be positioned end-to-end with other identical connectors without loss of terminal position between ends of the connectors along a circuit board. The right angle connector comprises:

an insulative housing having a first mating side, a second side substantially parallel to the first side, a plurality of rows and columns of passages extending from the first side through the housing to the second side, a third side substantially perpendicular to the first and second sides and for mounting on a circuit board, the third side having a substantially planar surface, an annular space recessed in the substantially planar surface, and an insulative cylindrical peg extending through the annular space;

a plurality of terminals having first end portions, second end portions and bent portions connecting the first end portions and the second end portions such that the first end portions are substantially perpendicular to the second end portions, one of the terminals held in each one of the passages; and an eyelet made with a solderable surface, the eyelet having a skirt portion and a cylindrical sleeve portion connected to the skirt portion and having partially sheared sections, the cylindrical sleeve portion positioned around the peg, the skirt portion substantially positioned in the annular space, the partially sheared sections pressed into the peg immovably attaching the eyelet on the peg.

BRIEF DESCRIPTION OF THE DRAWINGS

The invention can be more fully understood from the following detailed description thereof in connection with accompanying drawings described as follows.

DESCRIPTION OF THE PREFERRED EMBODIMENT(S)

Figure 1:
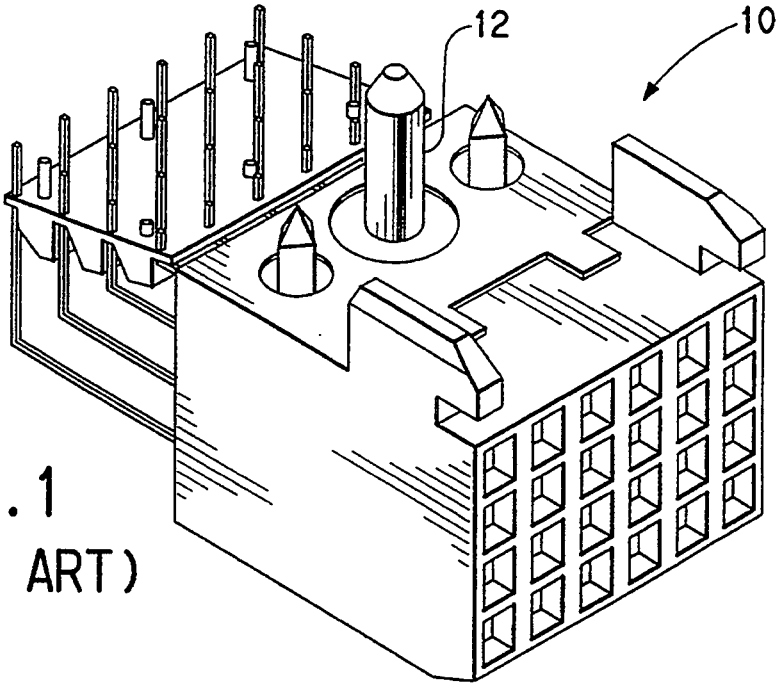
FIG. 1 (PRIOR ART)
FIG. 1 is a perspective view of a prior art right angle Metral TM receptacle having a plastic peg that can be used for mechanically attaching the receptacle to a circuit board through a heat staking process.

Throughout the following detailed description, similar reference characters refer to similar elements in all figures of the drawings.

Figure 2:
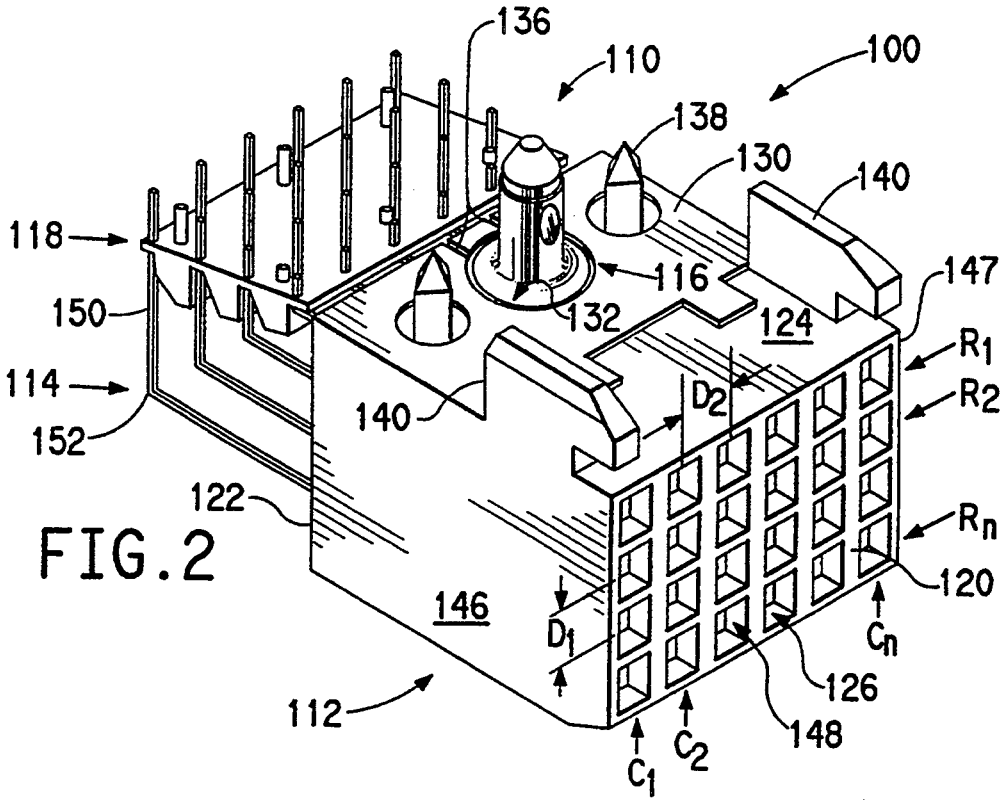
FIG. 2 is a perspective view of a right angle connector having a solderable hold-down of the present invention.

Referring to FIG. 2, there is illustrated a right angle connector 100 having a solderable hold-down 110 in accordance with the present invention. The right angle connector 110 may be a receptacle as illustrated in FIG. 2 or a header. The right angle connector 110 comprises an insulative housing 112, a plurality of terminals 114, and an eyelet 116. The right angle connector 110 may also comprise an insulative terminal spacer 118.

The insulative housing 112 has a first mating side 120, a second side 122 and a third side 124. The second side 122 is substantially parallel to the first side 120. A plurality of rows $R_1$–$R_n$ and columns $C_1$–$C_n$ of passages 126 extend from the first side 120 through the housing 112 to the second side 122. The third side 124 is substantially perpendicular to the first side 120 and the second side 122. The third side 124 is for mounting on a first circuit board 128. See FIG. 2. The third side 124 has a substantially planar surface 130. An annular space 132 is recessed in the substantially planar surface 130. An insulative cylindrical peg 134 extends through the annular space 132.

Figure 7:
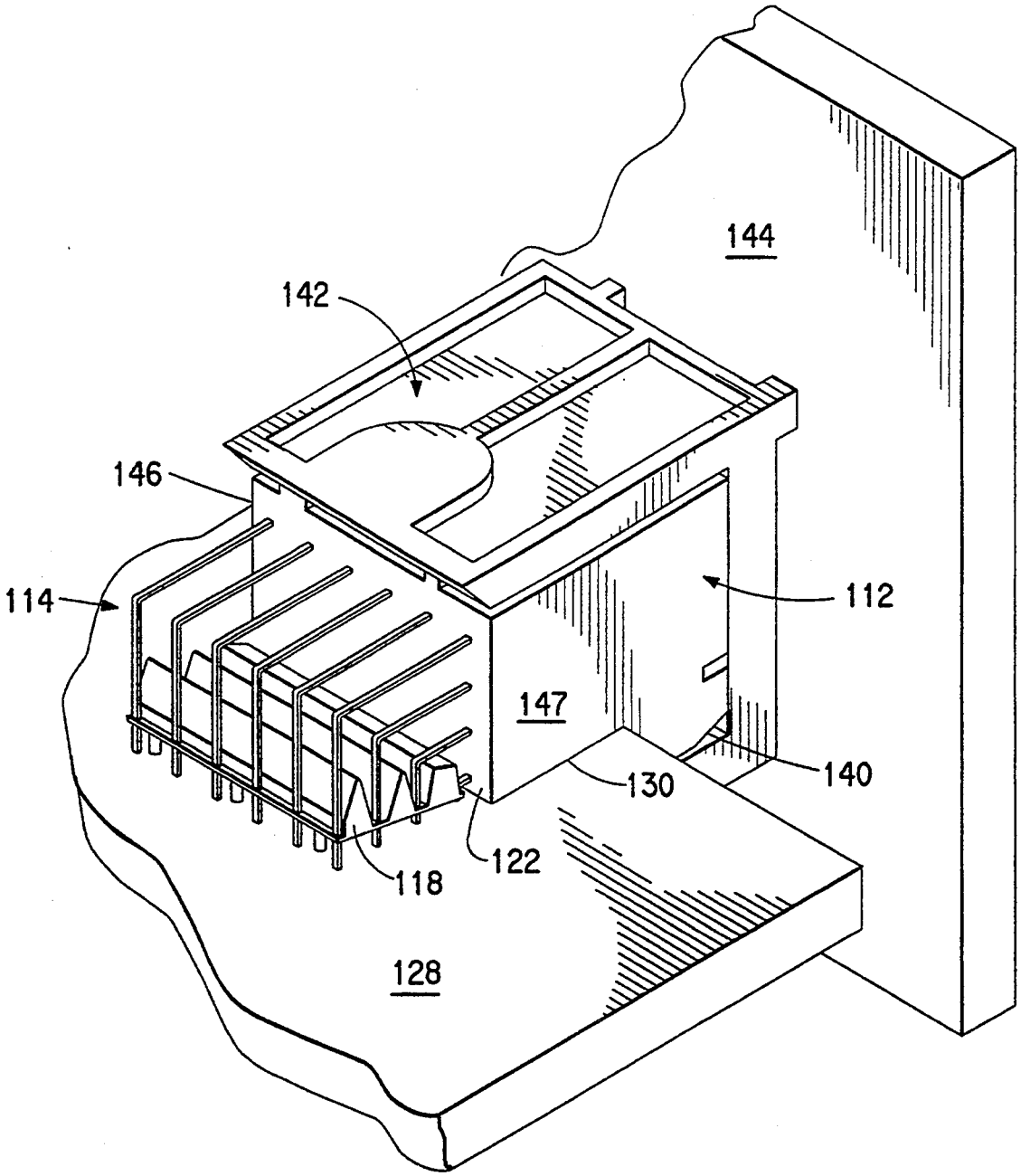
FIG. 7 is a perspective view of a connector assembly including a right angle receptacle mated with a vertical header interconnecting a first circuit board and a second circuit board perpendicular to the first circuit board.

The insulative housing 112 may include air and gas vent grooves 136 recessed in the substantially planar surface 130 connecting the annular space 132 with the second side 122. The insulative housing 112 may also include a pair of locating pegs 138 extending from the third side 124 for interference fit in holes (not depicted) through the circuit board 128 to hold the connector 100 to the board 128 prior to soldering the hold-down 110 to the board 128. The insulative housing 112 may further include a pair of ski noses 140 for positioning the receptacle 100 in a mating header 142 which, in turn, can be connected to a second circuit board 144 pendicular to the first circuit board 128. The ski noses can also be shaped to function as keys in a locking arrangement with a mating connector so that the connector 100 only fits in slots in a mating connector designed to receive the ski noses 140. See FIG. 7. Alternatively, the receptacle 100 can be connected to a right angle header (not depicted). In which case, the right angle header could be connected to a second circuit board parallel to the first circuit board 128.

The insulative housing 112 has a first end 146 and a second end 147. Preferably, the ends 146,147 are substantially perpendicular to the first, second and third sides 120,122,124 such that a plurality of the connectors 100 can be positioned end-to-end without loss of terminal position between ends of the connectors 100 along a circuit board.

The plurality of terminals 114 have first end portions 148, second end portions 150 and bent middle portions 152. The bent middle portions 152 connect the first end portions 148 and the second end portions 150 such that the first end portions 148 are substantially perpendicular to the second end portions 150. One of the terminal first end portions 148 is held in each one of the passages 126.

Preferably, there are at least four rows $R_1$–$R_4$ and a plurality of columns $C_1$–$C_n$ of the passages 126 through the housing 112. Preferably, the distance $D_1$ between the centerlines of adjacent pairs of the terminals 114 held in the rows R is 2 mm. Similarly, preferably, the distance $D_2$ between the centerlines of adjacent pairs of the terminals 114 held in the columns C is 2 mm. Preferably, when a plurality of the connectors 100 are positioned end-to-end, the distance between the centerlines of adjacent pairs of the terminals 114 in the end columns of the adjacently stacked connectors 100 is 2 mm.

Figure 3:
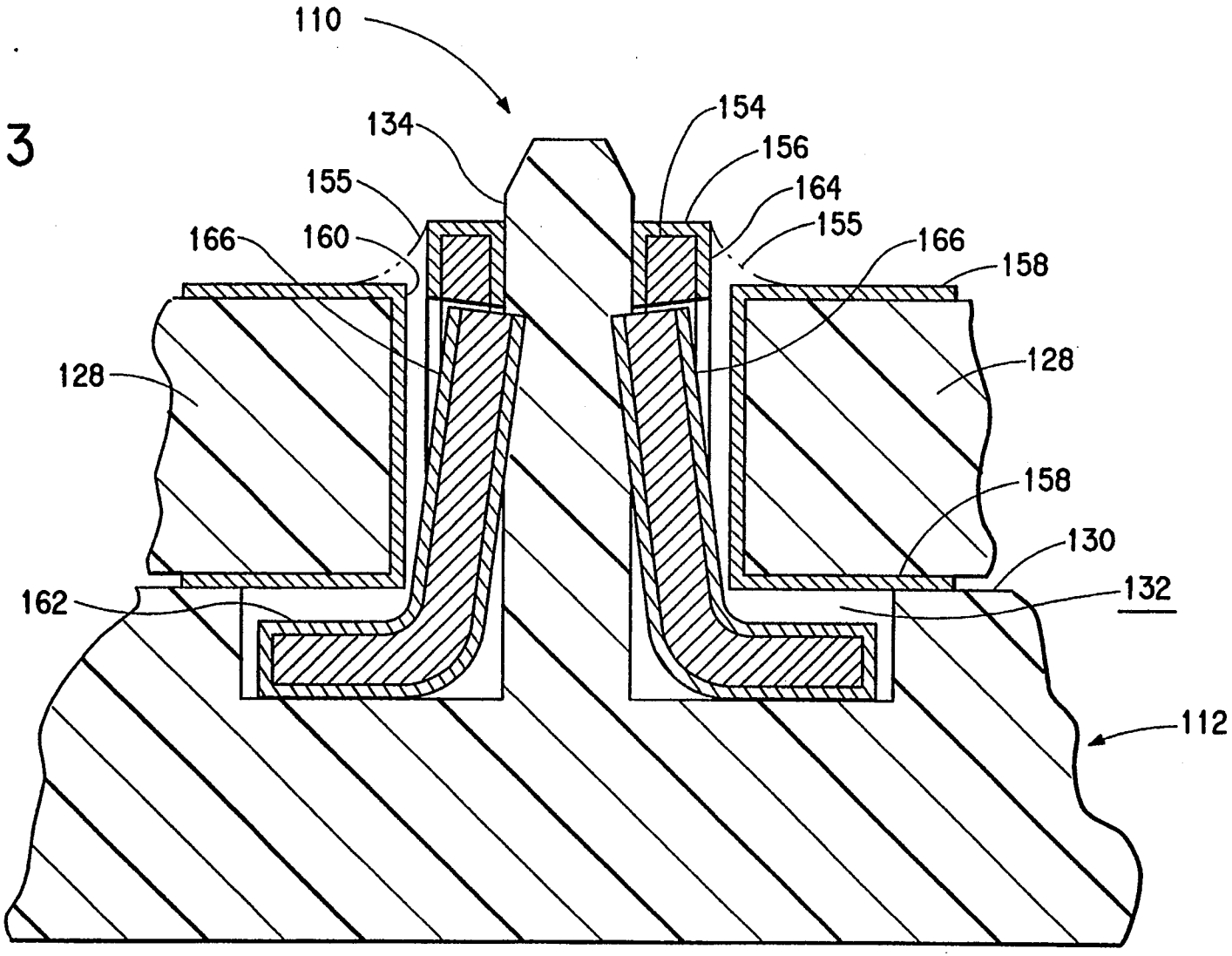
FIG. 3 is a cross sectional view of an enlarged section of FIG. 2 showing a cross section of the solderable hold-down in a soldering position adjacent to a circuit board.

The eyelet 116 is made with a solderable surface. The eyelet 116 comprises a metal core 154 and a metal layer 156 coating the core 154 such that the metal layer 156 is adapted to be held by solder to conductive pads 158 and plated-holes 160 through the circuit board 128. The core can be made of copper, brass, an alloy of copper and zinc or other suitable materials. The metal layer 156 can be tin, a tin-lead alloy, gold, a solder material or other suitable materials. The eyelet 116 has a skirt portion 162 and a cylindrical sleeve portion 164. The cylindrical sleeve portion 164 is connected to the skirt portion 162 and has partially sheared sections 166. The cylindrical sleeve portion 164 is positioned around the peg 134. The skirt portion 162 is substantially positioned in the annular space 132. The partially sheared sections 166 are pressed into the peg 134 immovably attaching the eyelet 116 to the peg 134. Preferably, there are two of the partially sheared sections 166 and they are on distal sides of the cylindrical sleeve portion 164. The partially sheared sections 166 are semi-conical as best seen in FIG. 2 and inclined about 10 degrees with respect to a longitudinal axis of the cylindrical sleeve portion 164 as best seen in FIG. 3. One or more barb can be added to the exterior of the cylindrical sleeve 164 to aid in retaining the connector 100 to the board 128 prior to soldering.

Referring to FIG. 3, the right angle connector 100 is mechanically attached to the circuit board 128 by locating its solderable hold-down 110 in a plated through hole 160. Then solder 155 is applied, for instance, in a solder wave process, such that solder 155 is wicked into empty spaces between the solderable hold-down 110 and the plated through hole 160. The solder 155 also fills or substantially fills empty space in the annular recess 132. Air or gas is displaced by the solder 155, such as through the vent grooves 136. This solder 155 can be applied simultaneously with soldering other parts, such as the first end portions 150 of the terminals 114, to the circuit board 128.

Figure 4:
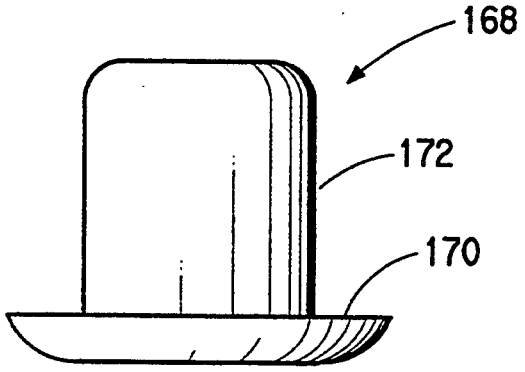
FIG. 4 is an elevation view of a rolled flange eyelet.

FIG. 4 illustrates a second embodiment of an eyelet 168 that can be used in the present invention. The shape of the eyelet 168 is known in the art as a rolled flange eyelet. Like the eyelet 116 of FIGS. 2 and 3, the rolled flange eyelet 168 has a skirt portion 170 and a cylindrical sleeve portion 172.

Figure 5:
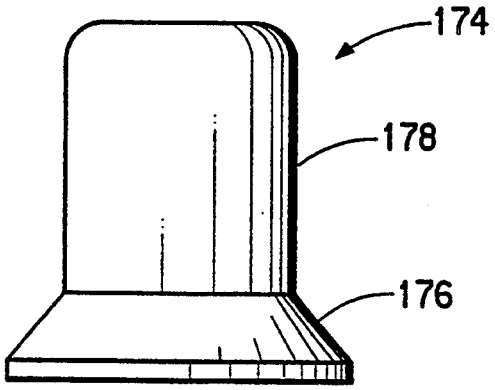
FIG. 5 is an elevation view of a funnel flange eyelet.

FIG. 5 illustrates a third embodiment of an eyelet 174 that can be used in the present invention. The shape of the eyelet 174 is known in the art as a funnel flange eyelet. Like the eyelet 116 of FIGS. 2 and 3, the funnel flange eyelet 174 has a skirt portion 176 and a cylindrical sleeve portion 178.

Figure 6:
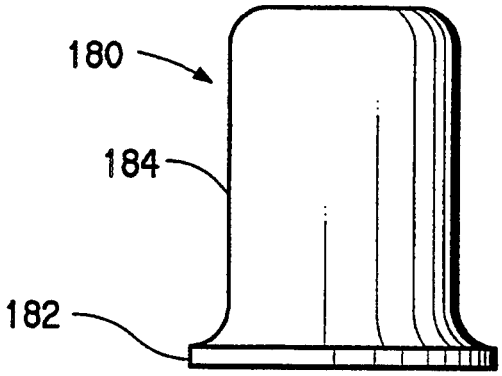
FIG. 6 is an elevation view of a flat flange eyelet.

FIG. 6 illustrates a fourth embodiment of an eyelet 180 that can be used in the present invention. The shape of the eyelet 180 is known in the art as a flat flange eyelet. Like the eyelet 116 of FIGS. 2 and 3, the flat flange eyelet 180 has a skirt portion 182 and a cylindrical sleeve portion 184. The eyelet 116 of FIGS. 2 and 3 is also a flat flange eyelet.

Those skilled in the art, having the benefit of the teachings of the present invention as hereinabove set forth, can effect numerous modifications thereto. These modifications are to be construed as being encompassed within the scope of the present invention as set forth in the appended claims.

What is claimed is:

1. A right angle connector/circuit board combination, comprising:

an insulative housing having a first mating side, a second side substantially parallel to the first side, a plurality of rows and columns of passages extending from the first side through the housing to the second side, a third side substantially perpendicular to the first and second sides and for mounting on a circuit board, having a hole, the third side having a substantially planar surface, an annular space recessed in the substantially planar surface, and an insulative cylindrical peg extending through the annular space and the hole on the circuit board;

a plurality of terminals having first end portions, second end portions and bent portions connecting the first end portions and the second end portions such that the first end portions are substantially perpendicular to the second end portions, one of the terminals held in each one of the passages; and an eyelet made with a solderable surface, the eyelet having a skirt portion and a cylindrical sleeve portion connected to the skirt portion and having partially sheared sections, the cylindrical sleeve portion positioned around the peg, the cylindrical sleeve portion being disposed in the hole, the cylindrical sleeve portion being soldered to the circuit board hole, the skirt portion substantially positioned in the annular space, the partially sheared sections pressed into the peg immovably attaching the eyelet on the peg.

2. The combination of claim 1, wherein the insulative housing includes vent grooves recessed in the substantially planar surface connecting the annular space with the second side.

3. The combination of claim 1, wherein there are two partially sheared sections that are on distal sides of the cylindrical sleeve portion and the two partially sheared sections are semi-conical and inclined about 10 degrees with respect to a longitudinal axis of the cylindrical sleeve portion.

4. The combination of claim 1, wherein the eyelet comprises a metal core and a metal layer coating the core such that the metal layer is adapted to be held by solder to a conductive pad and plated-hole through the circuit board.

5. The combination of claim 1, wherein the insulative housing includes a pair of locating pegs extending from the third side for interference fit in holes through the circuit board.

6. The combination of claim 5, wherein the insulative housing includes a pair of ski noses.

7. The combination of claim 1, wherein the insulative housing has a first end and a second end, the ends substantially perpendicular to the first, second and third sides such that a plurality of the connectors can be positioned end-to-end without loss of terminal position between ends of the connectors along a circuit board.

8. The combination of claim 7, wherein there are at least four rows and a plurality of columns of the passages, the distance between the centerlines of adjacent pairs of the terminals held in the rows being 2 mm, the distance between the centerlines of adjacent pairs of the terminals held in the columns being 2 mm, and when a plurality of the connectors are positioned end-to-end, the distance between the centerlines of adjacent pairs of the terminals in the end columns of the adjacently stacked connectors being 2 mm.

9. A connector assembly used in combination with a circuit board having a bore therein, said connector assembly comprising:

a insulative housing having an outer surface;

an insulative peg located on said outer surface of said insulative housing for positioning said insulative housing on the circuit board, said insulative peg extending through the bore on the circuit board; and a solderable eyelet disposed around said insulative peg for anchoring said insulative peg to the circuit board, a portion of said solderable eyelet being soldered to the bore of the circuit board.

10. The combination according to claim 9 wherein said insulative peg further comprises a proximal end proximate said insulative housing and a distal end distal to said insulative housing.

11. The combination according to claim 10 wherein said solderable eyelet further comprises:

a skirt portion disposed over the proximal end of said insulative peg;

a cylindrical sleeve portion disposed over the distal end of said insulative peg for receiving solder in said bore on the circuit board so as to anchor said solderable eyelet to the circuit board; and a partially sheared portion integrally located between said skirt portion and said cylindrical sleeve portion for engaging said insulative peg so as to anchor said insulative housing to said solderable eyelet.

12. The combination according to claim 11 wherein said partially sheared portion of said insulative peg is inclined about 10 degrees with respect to a longitudinal axis of said cylindrical sleeve portion.

* * * * *

UNITED STATES PATENT AND TRADEMARK OFFICE

CERTIFICATE OF CORRECTION

PATENT NO. : 5,385,489

DATED : January 31, 1995

INVENTOR(S) : Mark S. Schell

It is certified that error appears in the above-indentified patent and that said Letters Patent is hereby corrected as shown below:

Column 5, Line 29 through Column 6, Line 10 - Claim 9 should read as follows:

9. A connector assembly used in combination with a circuit board having a bore therein, said combination comprising:

an insulative housing having an outer surface;

an insulative peg located on said outer surface of said insulative housing for positioning said insulative housing on the circuit board, said insulative peg extending through the bore on the circuit board; and a solderable eyelet disposed around said insulative peg for anchoring said insulative peg to the circuit board, a portion of said solderable eyelet being soldered to the bore of the circuit board.

Signed and Sealed this

Sixteenth Day of May, 1995

*Attest:*

Bruce Lehman

BRUCE LEHMAN

*Attesting Officer*

*Commissioner of Patents and Trademarks*